United States Patent [19]

Barrett

[11] 3,993,163

[45] Nov. 23, 1976

[54] LADDER SOCKS

[76] Inventor: Donald Barrett, 618 Vernon, Glencoe, Ill. 60022

[22] Filed: Apr. 21, 1975

[21] Appl. No.: 570,280

[52] U.S. Cl. ..... 182/108

[51] Int. Cl.[2] ..... E06C 7/48

[58] Field of Search ..... 182/108, 107; 2/24, 2/267

[56] References Cited

UNITED STATES PATENTS

| | | | |
|---|---|---|---|
| 2,603,786 | 7/1952 | Haines | 2/24 |
| 2,904,128 | 9/1959 | Boham | 182/108 |
| 2,925,877 | 2/1960 | Wright | 182/108 |
| 3,062,319 | 11/1962 | Wright | 182/108 |
| 3,115,212 | 12/1963 | Keatley | 182/108 |
| 3,593,340 | 7/1971 | Powell | 2/24 |
| 3,662,856 | 5/1972 | Amico | 182/108 |

*Primary Examiner*—Reinaldo P. Machado
*Attorney, Agent, or Firm*—Alter and Weiss

[57] ABSTRACT

Universal protective socks to be used with ladders having side rails. When fastened in place, the socks prevent the ladder rails from marring any work surface upon which the ladder may be leaning.

4 Claims, 6 Drawing Figures

LADDER SOCKS

My invention relates generally to ladder accessories and more particularly to protective resilient socks which, when placed over ladder rails, prevents the ladders from marring any work surface on which the ladders may be leaning.

Workmen, such as painters or decorators, often must use the very surfaces upon which they are working as support for their ladders. In the process, the ladder rails may scratch or mar the fresh paint or plaster. Touching up these areas becomes a frustrating, time-consuming task, since each time the ladder must be moved, tools, paint, and painting implements must be taken off the ladder only to be replaced before the touching-up can continue. Also, as simple a task as changing a light bulb may result in damaged plaster or wallpaper, making more work for the already overburdened homeowner.

While providing cushioned surfaces on which ladders may rest, my invention also provides non-slip surfaces to hold the ladder more securely.

Previous attempts at protecting work surfaces from marring caused by ladder rails have focused on devices designed to fit snugly over the ends of the ladder rails. Protective devices thus adapted to fit one size of ladder rail may not fit another, making it necessary to buy a separate set of devices for each ladder owned, and a new set for each new ladder acquired.

Also, earlier devices were generally formed of a single material, which simultaneously had to be resilient, non-marring, and durable. No attempt was made to combine materials with unique structural characteristics to create a protective device utilizing all such advantages.

It is, therefore, an object of my invention to provide safety devices for use with ladders, which protect work surfaces from marring by the ladder rails.

A further object of this invention is to provide safety devices that are universally mountable on standard ladders with differently sized rails.

Another object of the present invention is to make my invention easily removable for transfer from ladder to ladder and for cleaning purposes.

Yet another object of the present invention is to fashion my invention from materials easily and conveniently machine-washable and dryable.

Another object of the present invention is to fashion my invention from outer and inner layers of differing materials, utilizing the resiliency of one material and the durability and strength of the other material.

A further object of the present invention is to design my invention to be positionable at any point along the length of a ladder side rail.

Yet another object of the present invention is to provide anti-slip surfaces to give the ladder safer and more secure contact with the work surface.

The above-mentioned and other features of my invention will become more apparent, and the invention will be best understood by reference to a preferred embodiment of the invention taken in conjunction with the accompanying drawings, in which.

Figure 1:
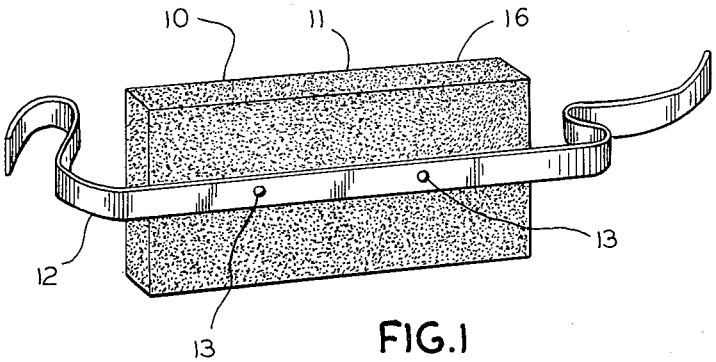
FIG. 1 is a perspective view of a first version of the ladder sock.
Figure 2:
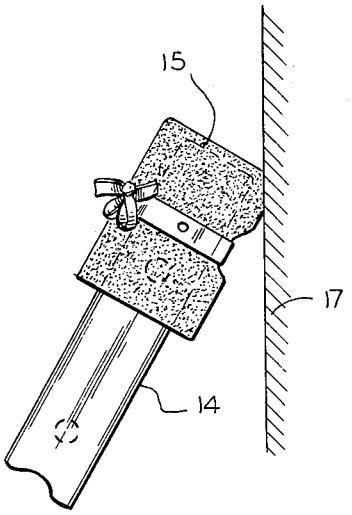
FIG. 2 is a side view, as installed, of the sock shown at FIG. 1.
Figure 3:
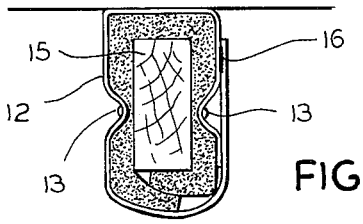
FIG. 3 is a top view of the sock as shown at FIG. 2.

In FIG. 1 of the drawings, the numeral 10 refers generally to a ladder sock consisting of a pad 11 of resilient polyurethane foam, or the like, selected for its resilient properties and for its ability to be folded about a shape such as a ladder rail. Securing strap 12 is permanently fastened to pad 11 by rivets 13 or by any other convenient fastening means. In use, pad 11 is folded in a generally U-shape, with side 16, opposite the side to which securing strap 12 is fastened, forming the inside surface of the "U". The sock is then placed about the ladder rail 14 to cover the ladder rail 15, with the closed end of the "U" placed over that part of the rail which is to be placed against the work surface 17. Securing strap 12 is then fastened, either by trying as shown in FIG. 2, or by use of a pressure-sensitive fastener such as a velcro strip as shown in FIG. 3. Thus positioned, contact between the work surface 17 and rivets 13 is prevented. In the event that fastening means other than rivets, i.e., stitched seams, or the like, are used to fasten the securing strap 12 to pad 11, contact of the fastening means with the work surface will not cause scratching or marring.

Figure 4:
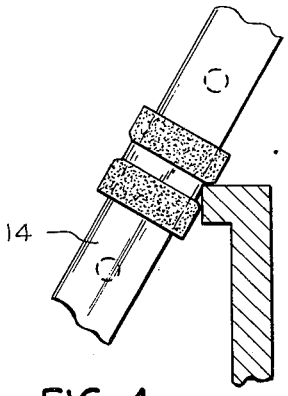
FIG. 4 is a side view of the ladder sock applied at a point other than at the end of the ladder side rail.

FIG. 4 illustrates the use of my invention to protect a window ledge, or the like, wherein the ladder is supported at a point other than at the end of the rails.

Figure 5:
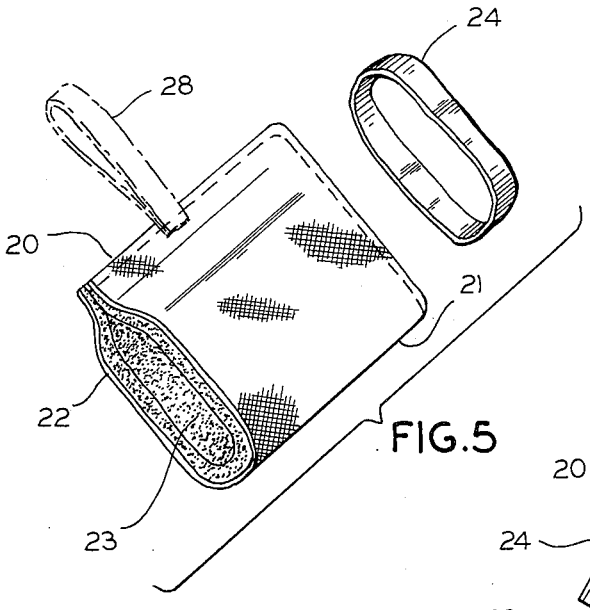
FIG. 5 is a perspective view of a second version of a ladder sock.
Figure 6:
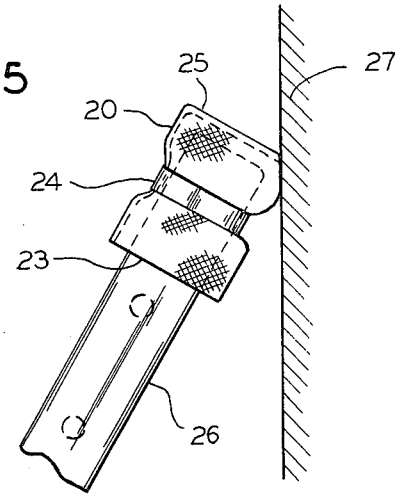
FIG. 6 is a side view of the ladder sock shown at FIG. 5, as installed.

Another preferred embodiment of the principles of my invention is shown at FIG. 5, wherein the sock 20 comprises a pocket 21, fashioned from a durable, non-skid, easily washable material, lined with a resilient pad 22 made of foam rubber, or the like. The opening 23 of pocket 21 is dimensioned to accommodate a wide range of ladder rail sizes. In use, the sock 20 is placed over the end 25 of ladder rail 26. Stretchable strap 24, fashioned from a stretchable material such as elastic, is then placed over sock 20 to secure it in place. Stretchable strap 24 may be supplied independently of the sock 20, or may be fastened integrally to sock 20 as shown, for example in phantom at 28 in FIG. 5.

While the principles of my invention have been described above in connection with specific apparatus and applications, it is to be understood that this description is made only by way of example and not as a limitation on the scope of of my invention.

I claim:

1. A universal protective pad for ladders having side rails, said protective pad comprising:

a pad member fashioned of single pliable, resilient material;

said pad member shaped to overlappingly encircle and protect the entire periphery of a selected portion of one of said side rails; and strap means attached to points on only one of the surfaces of said pad means, said points removed from the edges of said pad means, said strap means passing about the entire periphery of said protective pad to secure said pad at any point along one of said side rails even when said pad means overlapping encircles the side rails.

2. The device as recited in claim 1 wherein said pad material is a flexible polyurethane foam.

3. A universal protective pad for a ladder having side rails, said protective pad comprising:

protective means generally envelope shaped with closed sides and one open end to receive said rail end and to removably fit over the end of one of said side rails;

said protective means having an outer layer and an inner layer;

said inner layer being fashioned from resilient material;

said outer layer being fashioned from durable cloth material; and elastic strap means integral with said protective means and extending from said outer layer at one of said closed sides;

said strap means passing about the entire outer periphery of said protective means whereby said protective means is firmly held to said rail end.

4. The apparatus as recited in claim 3 wherein said strap means is integral with said protective means.

* * * * *

UNITED STATES PATENT OFFICE

CERTIFICATE OF CORRECTION

Patent No. 3,993,163 Dated November 23, 1976

Inventor(s) DONALD BARRETT

It is certified that error appears in the above-identified patent and that said Letters Patent are hereby corrected as shown below:

Col. 2, line 18: "trying" should be --tying--;

Signed and Sealed this

Nineteenth Day of April 1977

[SEAL]

*Attest:*

RUTH C. MASON
*Attesting Officer*

C. MARSHALL DANN
*Commissioner of Patents and Trademarks*